US006106141A

United States Patent [19]

Bruun

[11] Patent Number: 6,106,141

[45] Date of Patent: Aug. 22, 2000

[54] CONCRETE CHUTE WITH FLEXIBLE DISPENSING TUBE

[76] Inventor: Randy L. Bruun, 2167 Riverside, Beloit, Wis. 53511

[21] Appl. No.: 09/026,149

[22] Filed: Feb. 19, 1998

[51] Int. Cl.[7] ..... B28C 7/16

[52] U.S. Cl. ..... 366/68; 193/10

[58] Field of Search ..... 366/33, 44, 50, 366/53–59, 68, 187; 193/4, 10, 25 C, 25 R, 25 S

[56] References Cited

U.S. PATENT DOCUMENTS

| | | | |
|---|---|---|---|
| 2,072,301 | 3/1937 | Grayson | 366/68 |
| 3,249,192 | 5/1966 | Buskirk . | |
| 3,367,636 | 2/1968 | Duecy | 366/68 |
| 3,746,140 | 7/1973 | Schiffelbein | 193/5 |
| 3,866,889 | 2/1975 | Maxon, III | 366/68 |
| 4,054,194 | 10/1977 | Davis | 366/68 |
| 4,190,144 | 2/1980 | Lybbert | 193/10 |
| 4,551,024 | 11/1985 | Clapp | 366/50 |
| 4,586,824 | 5/1986 | Haws | 366/68 |
| 4,688,667 | 8/1987 | Peterson | 366/68 |
| 4,907,890 | 3/1990 | Lepper | 366/50 |
| 4,922,463 | 5/1990 | Del Zotto et al. | 366/50 |
| 5,154,271 | 10/1992 | Binzen . | |
| 5,178,252 | 1/1993 | Smith . | |
| 5,192,178 | 3/1993 | Silbernagel . | |
| 5,354,127 | 10/1994 | Del Zotto et al. | 366/50 |
| 5,605,398 | 2/1997 | Cronquist | 366/44 |

*Primary Examiner*—Charles E. Cooley

[57] ABSTRACT

A concrete chute system is provided including a concrete mixing vehicle with a chute mounted thereto. An open end of an auxiliary chute is detachably coupled to the chute of the concrete mixing vehicle to fluidly for receiving mixed concrete therefrom. The auxiliary chute also includes a central portion defined by a lower portion of a cylinder defining an open top and a pair of linear upper peripheral edges, a closed semicircular lower face. The auxiliary chute also has an aperture formed in the central portion adjacent to the lower face and a cylindrical flange coupled to the central portion about the aperture and extending downwardly therefrom. One end of a flexible tube is coupled to the flange for allowing mixed concrete to flow through the aperture and out the tube for dispensing.

5 Claims, 2 Drawing Sheets

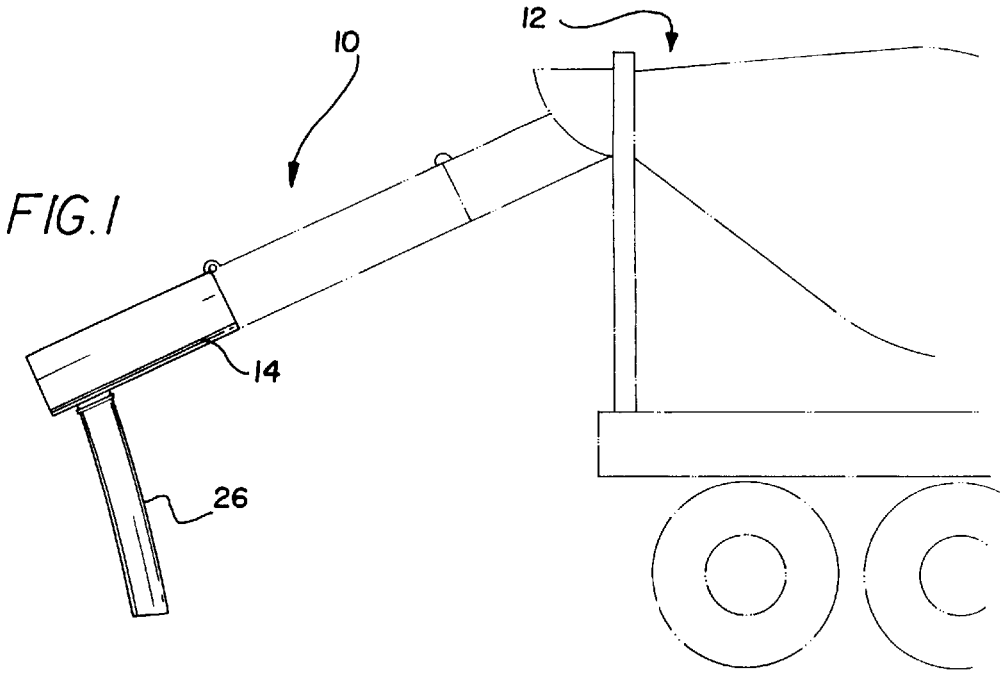
FIG. 1
FIG. 2
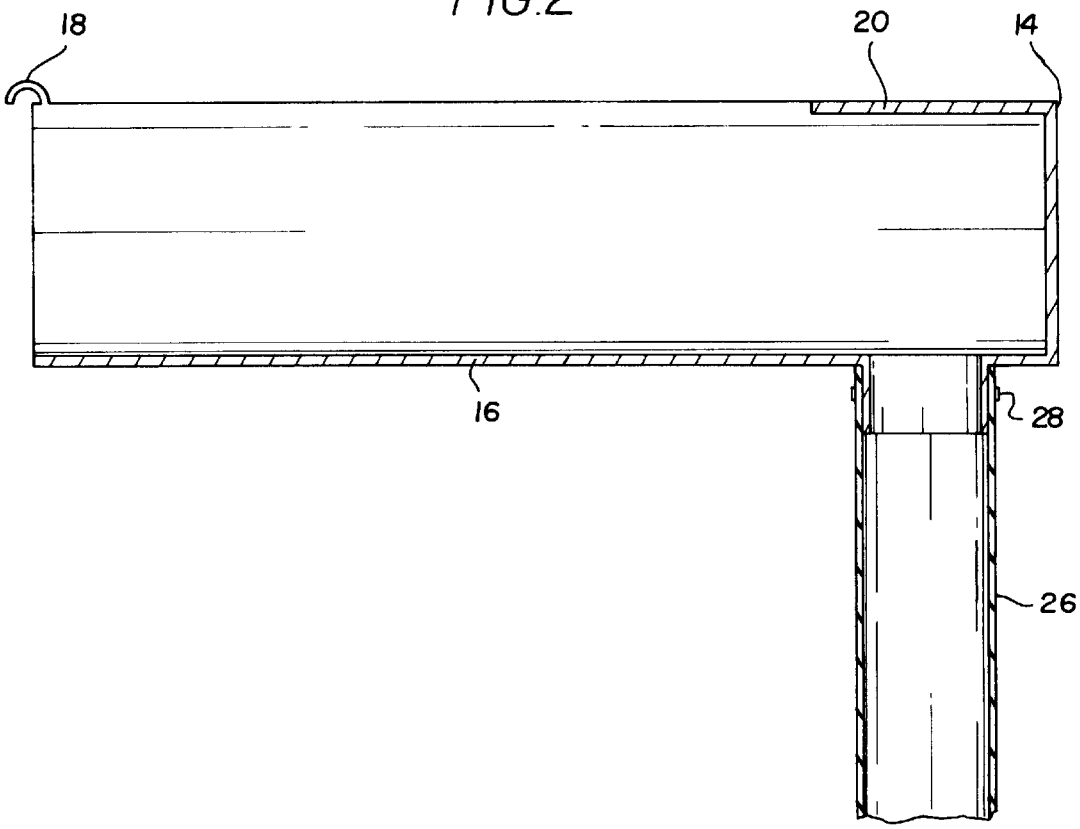

20
14
16

24
18
28
26
16

CONCRETE CHUTE WITH FLEXIBLE DISPENSING TUBE

BACKGROUND OF THE INVENTION

1. Field of the Invention

The present invention relates to concrete chutes and more particularly pertains to a new concrete chute with flexible dispensing tube for conveniently dispensing mixed concrete and further precluding the separation of the concrete during dispensing.

2. Description of the Prior Art

The use of concrete chutes is known in the prior art. More specifically, concrete chutes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,688,667; U.S. Pat. No. 5,178,252; U.S. Pat. No. 5,192,178; U.S. Pat. No. 5,354,128; and U.S. Pat. No. 5,154,271.

In these respects, the concrete chute with flexible dispensing tube according to the present invention substantially departs from the conventional concepts and designs of the prior art, and in so doing provides an apparatus primarily developed for the purpose of conveniently dispensing mixed concrete and further precluding the separation of the concrete during dispensing.

SUMMARY OF THE INVENTION

In view of the foregoing disadvantages inherent in the known types of concrete chutes now present in the prior art, the present invention provides a new concrete chute with flexible dispensing tube construction wherein the same can be utilized for conveniently dispensing mixed concrete and further precluding the separation of the concrete during dispensing.

The general purpose of the present invention, which will be described subsequently in greater detail, is to provide a new concrete chute with flexible dispensing tube apparatus and method which has many of the advantages of the concrete chutes mentioned heretofore and many novel features that result in a new concrete chute with flexible dispensing tube which is not anticipated, rendered obvious, suggested, or even implied by any of the prior art concrete chutes, either alone or in any combination thereof.

To attain this, the present invention is adapted for use with a concrete mixing vehicle having a chute mounted to a rear end thereof. A terminal end of the chute is equipped with a pair of horizontally oriented pins coupled thereto and extending radially therefrom. The present invention includes an auxiliary chute having a central portion defined by a lower portion of a cylinder. As shown in FIG. 3, the central portion has an open top, a pair of linear upper peripheral edges and a closed semicircular lower face. A pair of inverted U-shaped hooks are integrally coupled to the upper peripheral edges of the auxiliary chute adjacent to an open upper end thereof. The hooks function for releasably coupling with the pins of the chute of the concrete mixing vehicle for receiving mixed concrete therefrom. The auxiliary chute further includes a partial top plate having a planar rectangular configuration. The top plate is coupled between the upper peripheral edges of the central portion and an upper edge of the lower face. Ideally, the top plate extends along less than ¼ a length of the auxiliary chute. Formed in a bottom apex of the central portion is a circular aperture adjacent to the lower face underneath the top plate. A cylindrical flange is integrally coupled to the bottom apex of the central portion about the central aperture and extending downwardly therefrom for reasons that will soon become apparent. Finally, a tube is provided with a constant diameter equal to that of the aperture. The tube is constructed from a flexible elastomeric material. The tube has a pair of open ends one of which is coupled to the flange. This allows mixed concrete to flow through the aperture and out the tube for dispensing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new concrete chute with flexible dispensing tube apparatus and method which has many of the advantages of the concrete chutes mentioned heretofore and many novel features that result in a new concrete chute with flexible dispensing tube which is not anticipated, rendered obvious, suggested, or even implied by any of the prior art concrete chutes, either alone or in any combination thereof.

It is another object of the present invention to provide a new concrete chute with flexible dispensing tube which may be easily and efficiently manufactured and marketed.

It is a further object of the present invention to provide a new concrete chute with flexible dispensing tube which is of a durable and reliable construction.

An even further object of the present invention is to provide a new concrete chute with flexible dispensing tube which is susceptible of a low cost of manufacture with regard to both materials and labor, and which accordingly is then susceptible of low prices of sale to the consuming public, thereby making such concrete chute with flexible dispensing tube economically available to the buying public.

Still yet another object of the present invention is to provide a new concrete chute with flexible dispensing tube which provides in the apparatuses and methods of the prior art some of the advantages thereof, while simultaneously overcoming some of the disadvantages normally associated therewith.

Still another object of the present invention is to provide a new concrete chute with flexible dispensing tube for conveniently dispensing mixed concrete and further precluding the separation of the concrete during dispensing.

Even still another object of the present invention is to provide a new concrete chute with flexible dispensing tube that includes a concrete mixing vehicle with a chute mounted thereon. A tube formed from an elastomeric material is connected to the chute for accepting mixed concrete therefrom for dispensing purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of a new concrete chute with flexible dispensing tube according to the present invention.

FIG. 2 is a cross-sectional view of the auxiliary chute of the present invention.

DESCRIPTION OF THE PREFERRED EMBODIMENT

Figure 3:
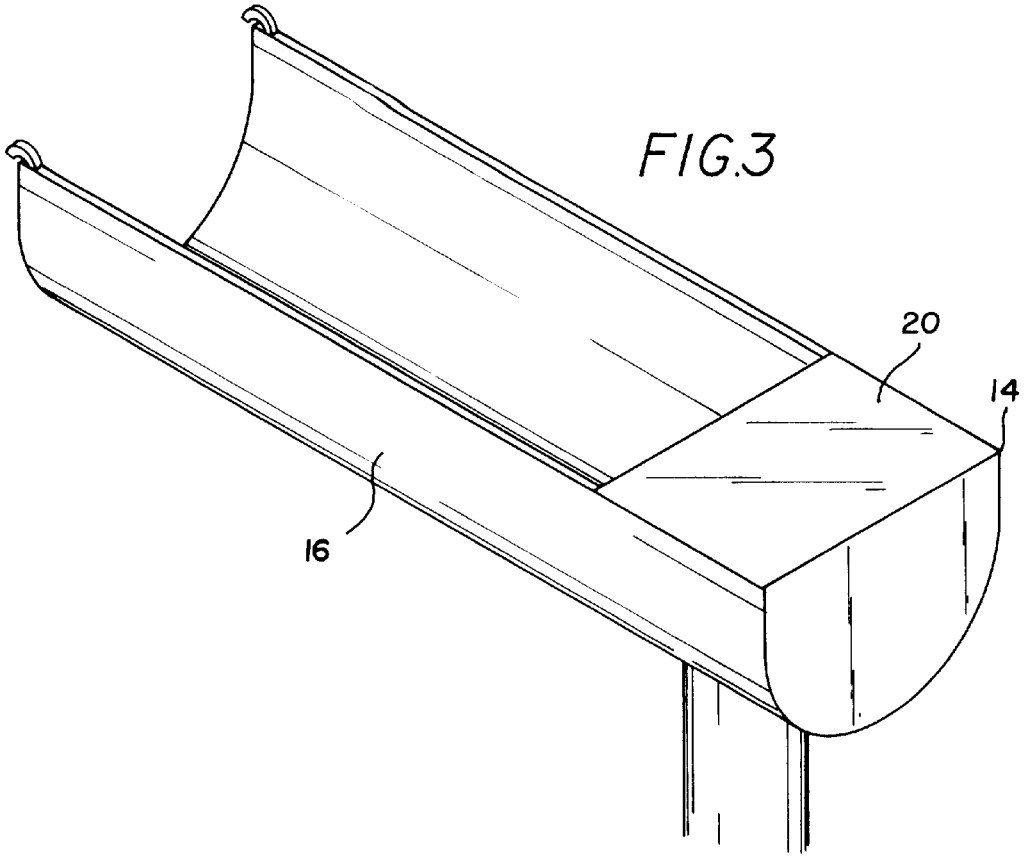
FIG. 3 is a top perspective view of the present invention.
Figure 4:
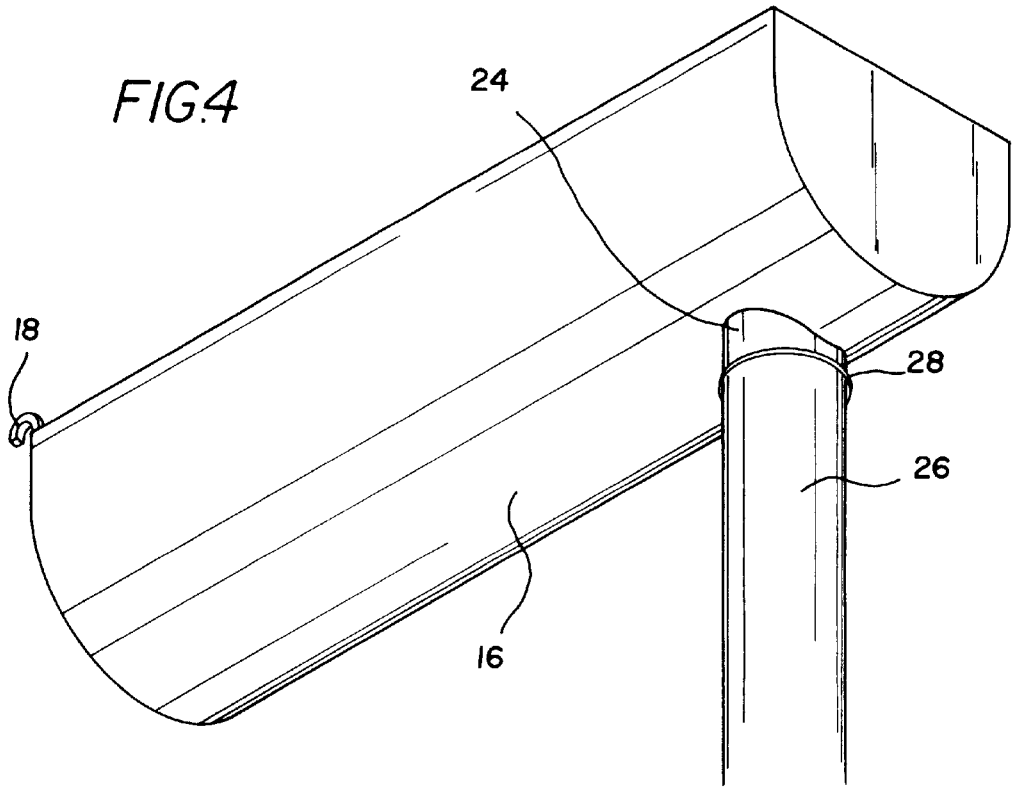
FIG. 4 is a bottom perspective view of the present invention.

With reference now to the drawings, and in particular to FIGS. 1 through 4 thereof, a new concrete chute with flexible dispensing tube embodying the principles and concepts of the present invention and generally designated by the reference numeral 10 will be described.

The present invention, designated as numeral 10, is adapted for use with a concrete mixing vehicle 12 having a chute mounted to a rear end thereof. A terminal end of the chute is equipped with a pair of horizontally oriented pins coupled thereto and extending radially therefrom.

The present invention includes an auxiliary chute 14 having a central portion 16 defined by a lower portion of a cylinder. Preferably, the central portion has a length of between 2–4 feet and a width of about 17 inches. As shown in FIG. 3, the central portion has an open top, a pair of linear upper peripheral edges and a closed semicircular lower face. In the preferred embodiment, the auxiliary chute has a length equal to that of each remaining section of the chute of the concrete mixing vehicle. While not shown, a pair of closed loops are preferably mounted to at least one of the upper peripheral edges of the auxiliary chute for releasably hanging the same on the vehicle.

A pair of inverted U-shaped hooks 18 are integrally coupled to the upper peripheral edges of the auxiliary chute adjacent to an open upper end thereof. As shown in FIG. 2, the hooks extend from the central portion and terminate in free ends. The hooks function for releasably coupling with the pins of the chute of the concrete mixing vehicle for receiving mixed concrete therefrom.

The auxiliary chute further includes a partial top plate 20 having a planar rectangular configuration. The top plate is coupled between the upper peripheral edges of the central portion and an upper edge of the lower face. Ideally, the top plate extends along less than ¼ a length of the auxiliary chute. Formed in a bottom apex of the central portion is a circular aperture adjacent to the lower face underneath the top plate. A cylindrical flange 24 is integrally coupled to the bottom apex of the central portion about the central aperture and extends downwardly therefrom for reasons that will soon become apparent.

Finally, an optional removable tube 26 is provided with a constant diameter equal to that of the aperture. Such diameter may be between 3–8 inches. The tube is constructed from a flexible elastomeric material. The tube has a pair of open ends one of which is coupled to the flange. A band 28 is preferably employed to facilitate such coupling. This allows mixed concrete to flow through the aperture and out the tube for dispensing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A concrete chute system comprising, in combination:

a concrete mixing vehicle with a chute mounted to a rear end of the vehicle, the chute having a terminal end with a pair of horizontally oriented pins being coupled to the terminal end and extending radially the end;

an auxiliary chute including a central portion, the central portion comprising a lower portion of a cylinder defining an open top and a pair of linear upper peripheral edges, the central portion having a closed semicircular lower face, a pair of inverted U-shaped hooks integrally coupled to the upper peripheral edges of the auxiliary chute adjacent to an open upper end thereof for releasably coupling with the pins of the chute of the concrete mixing vehicle for receiving mixed concrete from the chute, a partial top plate having a planar rectangular configuration coupled between the upper peripheral edges of the central portion and an upper edge of the lower face of the central portion, the top plate extending along less than ¼ a length of the auxiliary chute, a circular aperture formed in a bottom apex of the central portion adjacent to the lower face underneath the top plate, and a cylindrical flange integrally coupled to the bottom apex of the central portion about the aperture and extending downwardly therefrom; and a tube with a constant diameter equal to that of the aperture and constructed from an elastomeric material, the tube having a pair of open ends, one of the open ends being coupled to the flange for allowing mixed concrete to flow through the aperture and out the tube for dispensing.

2. A concrete chute system, comprising:

a concrete mixing vehicle with a chute mounted thereto;

an auxiliary chute including a central portion defined by a lower portion of a cylinder with an open top, a pair of linear upper peripheral edges, and a closed semicircular lower face;

the auxiliary chute having an open upper end opposite the lower face of the auxiliary chute, the auxiliary chute being detachably coupled to the chute of the concrete mixing vehicle for receiving mixed concrete from the chute;

the auxiliary chute having an aperture formed in the central portion adjacent to the lower face, and a cylindrical flange coupled to the central portion about the aperture and extending downwardly therefrom; and a flexible tube having a pair of open ends, one of the ends of the flexible tube being coupled to the flange for allowing mixed concrete to flow through the aperture and out the tube for dispensing;

wherein the chute of the concrete mixing vehicle has a pair of horizontally oriented pins coupled thereto and extending radially therefrom, wherein the auxiliary chute has a pair of inverted U-shaped hooks coupled to the upper peripheral edges of the auxiliary chute adjacent to the open upper end of the auxiliary chute for detachable coupling with the pins of the chute of the concrete mixing vehicle.

3. The concrete chute system of claim 2, further comprising a top plate being coupled between the upper peripheral edges of the central portion and an upper edge of the lower face.

4. The concrete chute system of claim 3, wherein the top plate extends along less than ¼ a length of the auxiliary chute defined between the upper and lower ends of the auxiliary chute, wherein the aperture is positioned underneath the top plate.

5. The concrete chute system of claim 2, wherein the tube has a constant diameter equal to that of the aperture and is constructed from an elastomeric material.

* * * * *